US010827565B2

(12) United States Patent
Naber et al.

(10) Patent No.: US 10,827,565 B2
(45) Date of Patent: Nov. 3, 2020

(54) INDUCTION COOKTOP SYSTEM WITH A TEMPERATURE SENSOR

(71) Applicant: Haier US Appliance Solutions, Inc., Wilmington, DE (US)

(72) Inventors: Christopher Nils Naber, Louisville, TX (US); Beau Muniz, Louisville, TX (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 304 days.

(21) Appl. No.: 15/920,957

(22) Filed: Mar. 14, 2018

(65) Prior Publication Data

US 2019/0289677 A1 Sep. 19, 2019

(51) Int. Cl.
*H05B 6/06* (2006.01)
*H05B 6/12* (2006.01)

(52) U.S. Cl.
CPC ..... *H05B 6/062* (2013.01); *H05B 6/1209* (2013.01)

(58) Field of Classification Search
CPC .. H05B 6/062; H05B 6/1209; H05B 2213/07; H05B 6/1263
USPC ..... 219/620, 621, 624, 627, 635
See application file for complete search history.

(56) References Cited

U.S. PATENT DOCUMENTS

| | | | | |
|---|---|---|---|---|
| 3,742,179 | A | 6/1973 | Harnden, Jr. | |
| 6,417,496 | B1 * | 7/2002 | Bates | H05B 3/746 219/448.11 |
| 9,191,998 | B2 | 11/2015 | Hegedis et al. | |
| 2010/0237064 | A1 * | 9/2010 | Liu | H05B 6/1209 219/622 |
| 2012/0118874 | A1 * | 5/2012 | Williams | H05B 6/1209 219/620 |

* cited by examiner

*Primary Examiner* — Phuong T Nguyen
(74) *Attorney, Agent, or Firm* — Dority & Manning, P.A.

(57) ABSTRACT

A temperature sensor assembly includes a casing that is mountable to a mat at a hole of the mat. The mat is positioned between a top plate and a bottom plate of the casing when the casing is positioned within the hole of the mat. A temperature sensor is disposed within the casing between the top plate and the bottom plate of the casing. The temperature sensor is encased within the potting compound inside the casing.

18 Claims, 4 Drawing Sheets

INDUCTION COOKTOP SYSTEM WITH A TEMPERATURE SENSOR

FIELD OF THE INVENTION

The present subject matter relates generally to induction cooktops.

BACKGROUND OF THE INVENTION

Induction cooktops generally have one or more induction heating elements configured for heating a cooking utensil. The cooking utensil, e.g., a pot or a pan, may be placed on the cooktop and food products (including, e.g., food solids, liquid, or water) may be placed inside the cooking utensil for cooking. A controller may selectively energize a magnetic coil of the induction heating element(s) to form of an alternating magnetic field which causes the cooking utensil to generate heat.

Many food products require careful monitoring and control of the cook time and temperature in order to provide optimal cooking results. In order to obtain precise feedback and control of the temperature of the food products as they are heated/cooked, a temperature probe may be placed in thermal communication with the cooking utensil. Temperature information is communicated to a control housing, which typically includes control electronics and a display for displaying the temperature of the cooking utensil and food products therein.

Known temperature probes suffer drawbacks. For example, known temperature probes can block the magnetic field from the induction heating element, become inoperable when exposed to water and/or scratch components of the induction cooktops.

BRIEF DESCRIPTION OF THE INVENTION

Aspects and advantages of the invention will be set forth in part in the following description, or may be apparent from the description, or may be learned through practice of the invention.

In a first example embodiment, an induction cooktop system includes a housing with a top panel. An induction coil is positioned within the housing below the top panel. A mat is positionable on the top panel of the housing. The mat defines a hole. A temperature sensor assembly includes a casing mountable to mat at the hole of the mat. The casing has a top plate and a bottom plate. The mat is positioned between the top plate and the bottom plate of the casing when the casing is positioned within the hole of the mat. A temperature sensor is disposed within the casing between the top plate and the bottom plate of the casing. The temperature sensor is encased within the potting compound inside the casing.

In a second example embodiment, an induction cooktop system includes a housing with a ceramic top panel. An induction coil is positioned within the housing below the ceramic top panel. A silicon mat is positionable on the ceramic top panel of the housing. The silicon mat defines a hole. A temperature sensor assembly includes an aluminum casing mountable to silicon mat at the hole of the silicon mat. The aluminum casing has a top plate and a bottom plate. The silicon mat is positioned between the top plate and the bottom plate of the aluminum casing when the aluminum casing is positioned within the hole of the silicon mat. A temperature sensor is disposed within the aluminum casing between the top plate and the bottom plate of the aluminum casing. The temperature sensor is encased within a potting compound inside the aluminum casing.

In a third example embodiment, an induction cooktop temperature measurement system includes a silicon mat that defines a circular hole. A temperature sensor assembly includes an aluminum casing mountable to silicon mat at the circular hole of the silicon mat. The aluminum casing has a top plate and a bottom plate. The silicon mat is positioned between the top plate and the bottom plate of the aluminum casing when the aluminum casing is positioned within the hole of the silicon mat. A temperature sensor is disposed within the aluminum casing between the top plate and the bottom plate of the aluminum casing. The temperature sensor is encased within a potting compound inside the aluminum casing. An elastic pad is positioned on the bottom plate of the aluminum casing.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
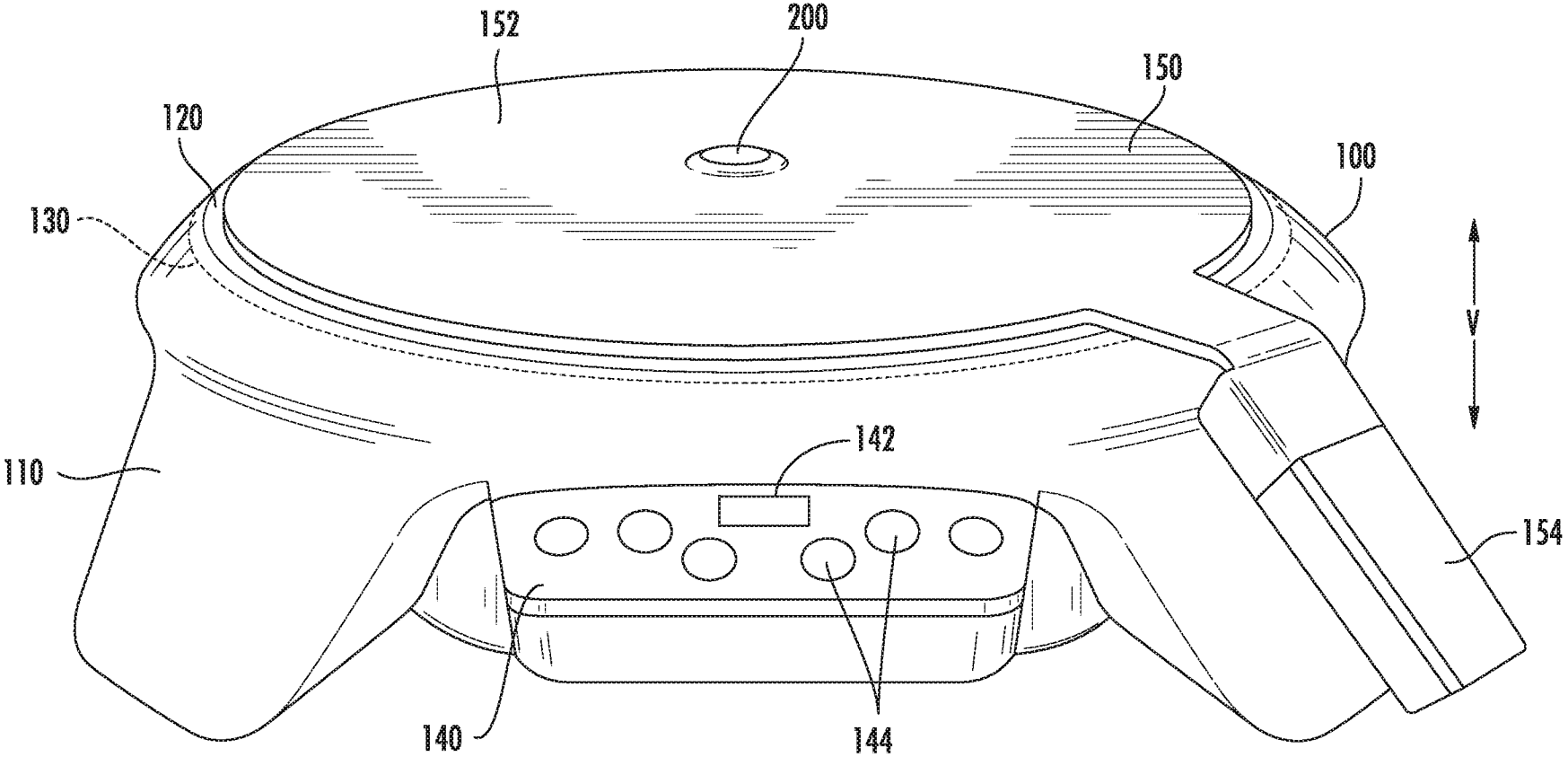
FIG. 1 is a front perspective view of an induction cooktop system according to an example embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a front perspective view of an induction cooktop system in accordance with an example embodiment of the present disclosure. As shown in FIG. 1, the induction cooktop system includes an induction cooker 100, a mat 150 and a temperature sensor assembly 200. As discussed in greater detail below, temperature sensor assembly 200 is advantageously removable from mat 150.

Induction cooker 100 includes a housing 110 with a top panel or plate 120 positioned at a top portion of housing 110. Top plate 120 may be constructed of or with a ceramic glass or any other suitable magnetically permeable and/or heat resilient material. A cookware item, such as a cooking pot or pan, may be positioned directly on top plate 120. Alternatively, as shown in FIG. 1, the cookware item may be positioned on mat 150 that is disposed on top plate 120. In either arrangement, a bottom surface of the cookware item may be positioned proximate top plate 120 of induction cooker 100. It should be appreciated that the cookware item may be comprised of any suitable ferromagnetic material. As an example, in one exemplary embodiment, the cookware item may be comprised of iron (Fe). In another exemplary embodiment, the cookware item may be comprised of nickel (Ni). In yet another alternative exemplary embodiment, the cookware item may be comprised of cobalt (Co). It should also be appreciated, however, that the cookware item may be comprised of any suitable alloys of iron (Fe), nickel (Ni), or cobalt (Co).

Induction cooker 100 includes an induction coil 130 positioned beneath the top plate 120 along the vertical direction V. Induction coil 130 includes a conductive material. For example, induction coil 130 may include a Litz wire. In operation, a time-varying magnetic field may be emitted from induction coil 130 when an electric current (i.e., alternating current) flows through induction coil 130. Further, the time-varying magnetic field may penetrate or engage a bottom surface of the cookware item above top plate 120. Still further, the time-varying magnetic field induces one or more electric currents in the cookware item. These one or more electric currents are generally referred to as "eddy currents", and these eddy currents dissipate heat that increases the temperature of the cookware item. Accordingly, the heat from the eddy currents may be used to cook the food item contained within the cookware item.

Induction cooker 100 may also include a control panel 140 having a display 142 and a plurality of input buttons 144. The display 142 may be a liquid crystal diode (LCD) display that provides visual information to a user. For example, the visual information may include textual information indicating a temperature of the induction cooker 100, specifically the top plate 120 or the cookware item on top plate 120. Input buttons 144 may be used to adjust one or more settings of the induction cooker 100. For example, a cook time may be increased or decreased through the use of one or more of input buttons 144. As will be discussed below in more detail, the operation of induction cooker 100 may be controlled by a processing device or controller (not shown) that is operatively coupled to control panel 140.

In FIG. 1, mat 150 is shown positioned on top plate 120. Thus, e.g., a user of induction cooker 100 may place the cookware item on mat 150 such that mat 150 is positioned between the cookware item and top plate 120 along the vertical direction V. Mat 150 supports temperature sensor assembly 200 such that temperature sensor assembly 200 is operable to measure the temperature of the cookware item when the cookware item is positioned on mat 150.

Figure 2:
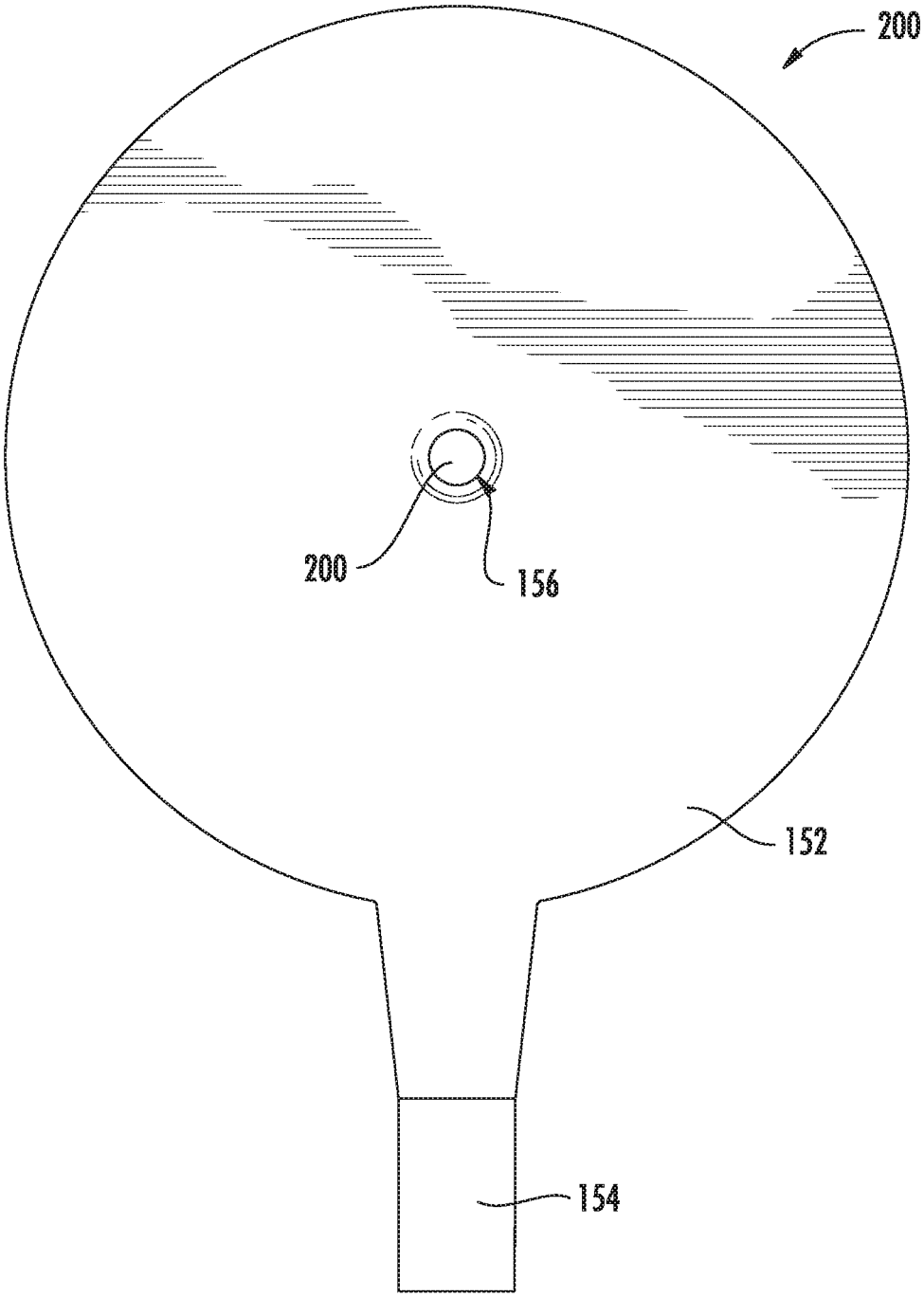
FIG. 2 is a top plan view of a mat and a temperature sensor assembly of the example induction cooktop system of FIG. 1.

FIG. 2 is a top plan view of mat 150 and temperature sensor assembly 200. In FIG. 2, mat 150 is shown removed from induction cooker 100. Thus, it will be understood that mat 150 is removable from induction cooker 100, e.g., to clean mat 150 or when another sensor is used to measure the temperature of the cookware item.

As shown in FIG. 2, mat 150 may include a circular portion 152. Circular portion 152 of mat 150 may be sized complementary to top plate 120, and circular portion 152 may rest on top plate 120 during operation of induction cooker 100. Temperature sensor assembly 200 may be positioned at or adjacent the center of circular portion 152 in certain example embodiments. Thus, temperature sensor assembly 200 may advantageously measure the temperature of cookware item on mat 150 at or adjacent a center of the cookware item.

Mat 150 may also include a communication module 154 that operable to establish signal communication between the controller of induction cooker 100 and temperature sensor assembly 200. Thus, communication module 154 may facilitate wireless communication, e.g., via a Bluetooth® or Wi-Fi® transmission protocol, between the controller of induction cooker 100 and temperature sensor assembly 200. In particular, a wire may extend through mat 150 from temperature sensor assembly 200 to communication module 154 in order to allow communication module 154 to transmit temperature measurements from temperature sensor assembly 200 to the controller of induction cooker 100. In other example, mat 150 need not include communication module 154 for wireless communication between temperature sensor assembly 200 and the controller of induction cooker 100. For example, mat 150 and induction cooker 100 may include a combination of plug and socket that establish a wired connection between temperature sensor assembly 200 and the controller of induction cooker 100. The operation of induction cooker 100 in view of temperature measurements from temperature sensor assembly 200 may be performed in a manner similar to that described in U.S. Patent Publication No. 2017/0138797, which is incorporated by reference herein in its entirety for all purposes. As shown in FIG. 2, communication module 154 may extend radially from circular portion 152 of mat 150.

Mat 150 may be constructed of or with a magnetically permeable material. For example, mat 150 may be constructed of or with silicon. Thus, e.g., mat 150 may advantageously avoid scratching top plate 120 and/or may advantageously limit heat transfer between top plate 120 and the cookware item on mat 150 while permitting the magnetic field from induction coil 130 to pass through mat 150 to the cookware item on mat 150.

Figure 3:
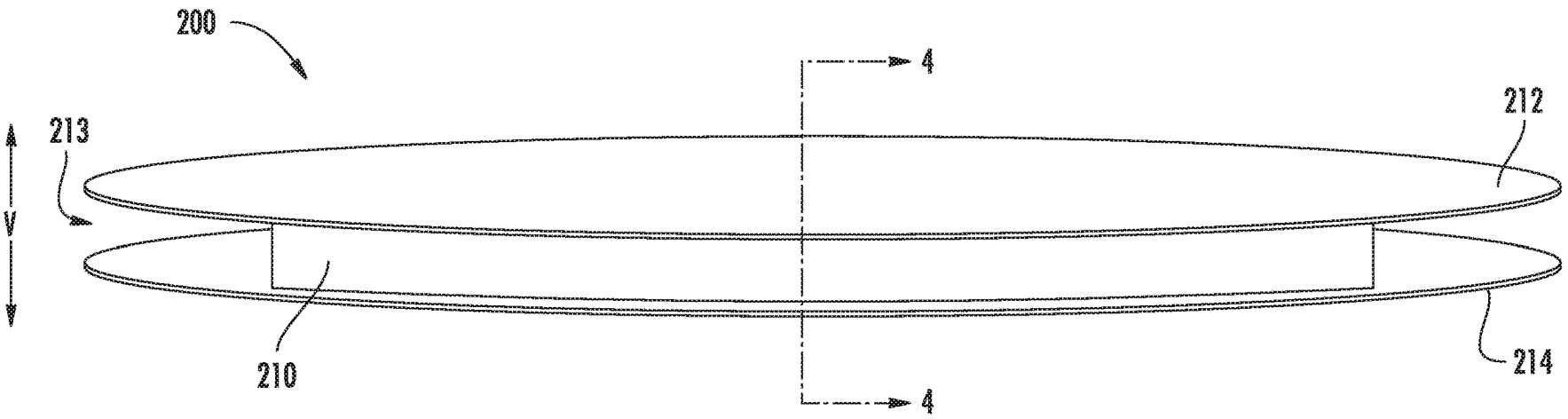
FIG. 3 is a perspective view of the temperature sensor assembly of FIG. 2.

As discussed above, temperature sensor assembly 200 is removable from mat 150. Thus, temperature sensor assembly 200 is selectively adjustable between a mounted configuration (FIG. 2) and an unmounted configuration (FIG. 3). Temperature sensor assembly 200 is positioned in mat 150 at a hole 156 of mat 150 in the mounted configuration. Conversely, temperature sensor assembly 200 is removed from hole 156 of mat 150 in the unmounted configuration. Mat 150 and/or temperature sensor assembly 200 may be cleaned more easily when separated compared to when mat 150 and temperature sensor assembly 200 are permanently attached to each other, e.g., when temperature sensor assembly 200 is over-molded in mat 150.

Figure 4:
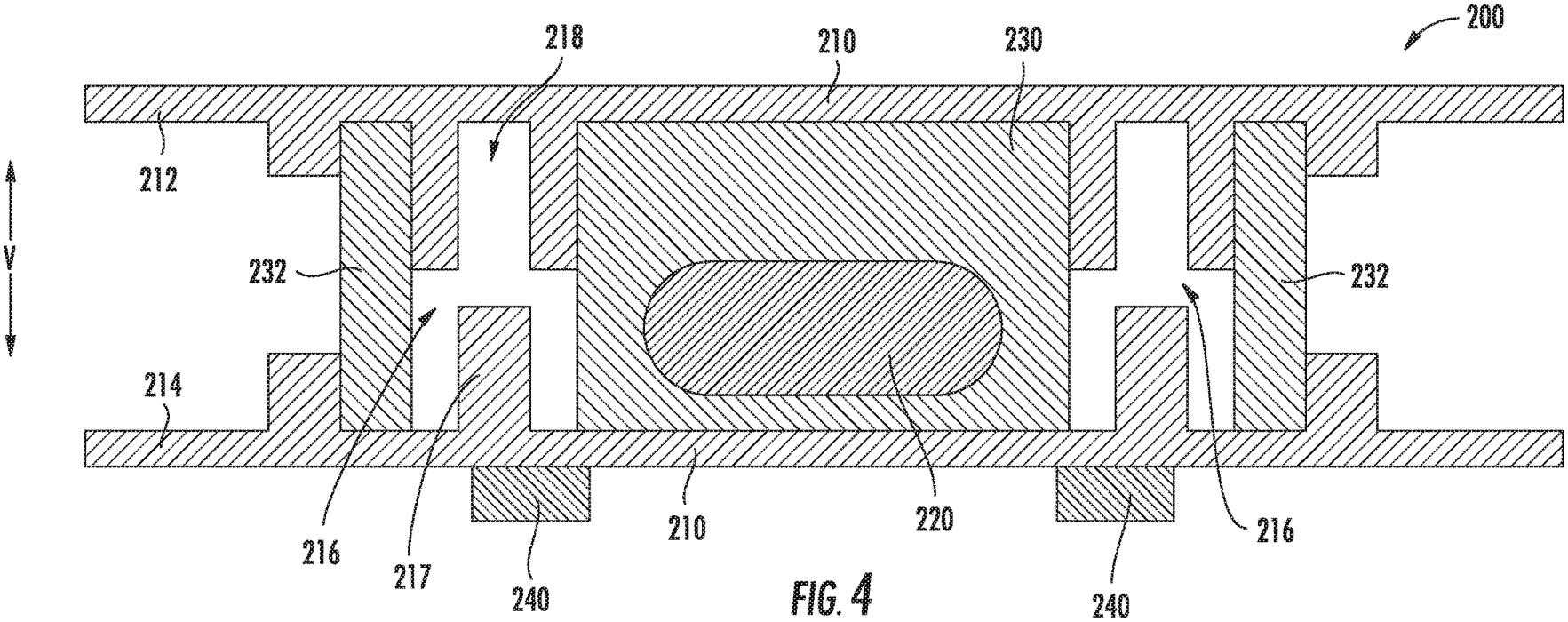
FIG. 4 is a partially exploded section view of the temperature sensor assembly of FIG. 2.

FIG. 4 is a partially exploded section view of temperature sensor assembly 200. Components of temperature sensor assembly 200 are discussed in greater detail below in the context of FIGS. 3 and 4. As may be seen in FIGS. 3 and 4, temperature sensor assembly 200 includes a casing 210. Casing 210 is mountable to mat 150 at hole 156 of mat 150. For example, casing 210 has a top plate 212 and a bottom plate 214. Mat 150 may be positioned between top plate 212 and bottom plate 214 of casing 210 when casing 210 is positioned within hole 156 of mat 150. Thus, e.g., an edge of mat 150 at hole 156 of mat 150 may be received within a slot 213 defined between top plate 212 and bottom plate 214 of casing 210, e.g., along the vertical direction V. In particular, hole 156 of mat 150 may be circular, e.g., in a plane that is perpendicular to the vertical direction V, and slot 213 may be annular, e.g., in the plane that is perpendicular to the vertical direction V. Thus, when casing 210 is mounted to mat 150, a user may deform mat 150 at or adjacent hole 156 of mat 150 in order to remove the edge of mat 150 from slot 213, and the user may then lift casing 210 from hole 156 of mat 150 to remove casing 210 from mat 150. Similarly, when casing 210 is removed from mat 150, the user may insert the edge of mat 150 into slot 213, and the user may then deform mat 150 at or adjacent hole 156 of mat 150 in order to slide casing 210 into hole 156 of mat 150 until the edge of mat 150 is completely within slot 213 to mount casing 210 to mat 150.

Casing 210 may be constructed of a material that is thermally conductive. For example, casing 210 may be constructed of or with aluminum. In particular, top plate 212 and bottom plate 214 of casing 210 may both be machined from aluminum blocks. Thus, casing 210 may advantageously transfer heat between a cookware item, e.g., positioned on top plate 212, and a temperature sensor 220 within casing 210. Casing 210 may define a height along the vertical direction between top plate 212 and bottom plate 214. The height of casing 210 may be no greater than one half inch (0.5") in certain example embodiments. Thus, casing 210 may be thin along the vertical direction V to avoid obstructing the magnetic field from induction coil 130.

Top plate 212 and bottom plate 214 of casing 210 are mounted to each other. For example, top plate 212 may be mounted to bottom plate 214 at a press-fit interface 216, which is shown separated in FIG. 4. Press-fit interface 216 includes a stub 217 and a stub hole 218. In the example embodiment shown in FIG. 4, stub 217 extends upwardly along the vertical direction V from bottom plate 214, and stub hole 218 is defined by top plate 212. Stub 217 is pressed into stub hole 218 in order to mount top plate 212 and bottom plate 214 together with press-fit interface 216. It will be understood that the positions of stub 217 and stub hole 218 on top and bottom panels 212, 214 shown in FIG. 4 may be reversed in alternative example embodiments. In addition, other suitable mounting mechanisms may be used to mount top plate 212 to bottom plate 214 in alternative example embodiments. For example, top plate 212 and bottom plate 214 may be mounted to each other with fasteners, adhesive, a threaded connection, etc. in alternative example embodiments.

It will be understood that while described above in the context of a separate top plate 212 and bottom plate 214 that are press-fit together, casing 210 may be a one-piece casing in alternative example embodiments. In particular, casing 210 may be formed by machining and/or casting a single piece of metal, such as aluminum. In such embodiments, top plate 212 and bottom plate 214 may be integrally formed by the one-piece casing.

As noted above, temperature sensor 220 is disposed within casing 210 between top plate 212 and bottom plate 214, e.g., along the vertical direction V. Temperature sensor 220 may include a thermistor, a thermocouple, a resistance temperature detector, etc. for measuring a temperature of a cookware item, e.g., positioned on top plate 212.

Casing 210 may prevent damage to temperature sensor 220, e.g., due to physical impacts. Thus, e.g., casing 210 may form a rigid shell around temperature sensor 220. Temperature sensor assembly 200 may also include a potting compound 230 that protects temperature sensor 220. Within casing 210, temperature sensor 220 may be encased within potting compound 230. Thus, potting compound 230 may surround temperature sensor 220 to prevent water or other liquids from contacting temperature sensor 220. In particular, potting compound 230 may waterproof the temperature sensor 220 within casing 210. In addition, potting compound 230 may extend between casing 210 and temperature sensor 220 to support temperature sensor 220 within casing 220 and prevent undesirable movement of temperature sensor 220 within casing 220. Additional potting compound 232 may also be positioned at or within press-fit interface 216 to assist with sealing the interior of casing 210 and limit ingress of water or other liquid into casing 210 at press-fit interface 216. Potting compound 230 and additional potting compound 232 may be a thermosetting plastic, silicone rubber gel, epoxy, etc.

Temperature sensor assembly 200 may also include a plurality of elastic pads 240. Pads 240 are positioned on bottom plate 214. When mat 150 is positioned on top panel 120 and casing 210 is positioned within hole 152 of mat 150, pads 240 may extend between bottom plate 214 and top panel 120. Thus, pads 240 may limit or prevent casing 210 from contacting top panel 120 when temperature sensor assembly 200 is mounted to mat 150. In such a manner, undesirable scratching of top panel 120 may be avoided or limited. Pads 240 may be silicon pads in certain example embodiments. Pads 240 may also advantageously assist with limiting conductive heat transfer between casing 210 and top panel 120.

As may be seen from the above, temperature sensor assembly 200 is configured to measuring a temperature of a cookware item positioned on mat 150. The above described features of temperature sensor assembly 200 may facilitate thermal conduction between the cookware item on top plate 212 to the temperature sensor 220 within casing 210. In addition, the above described features of temperature sensor assembly 200 may resist water ingress to temperature sensor 220 within casing 210. Further, the above described features of temperature sensor assembly 200 may provide a thin temperature sensor that does not overly obstruct the magnetic field from induction coil 130. Finally, the above described features of temperature sensor assembly 200 may avoid damaging top panel 120 while utilizing temperature sensor assembly 200 to measure the temperature of cookware item positioned on mat 150.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An induction cooktop system, comprising:

a housing with a top panel;

an induction coil positioned within the housing below the top panel;

a mat positionable on the top panel of the housing, the mat defining a hole; and a temperature sensor assembly comprising a casing mountable to the mat at the hole of the mat, the casing having a top plate and a bottom plate, the mat positioned between the top plate and the bottom plate of the casing when the casing is positioned within the hole of the mat;

a temperature sensor disposed within the casing between the top plate and the bottom plate of the casing;

a potting compound, the temperature sensor encased within the potting compound inside the casing such that the potting compound blocks liquids from contacting the temperature sensor, wherein the temperature sensor comprises a thermistor, a thermocouple, or a resistance temperature detector, and wherein the mat and the temperature sensor assembly are positioned over the top panel of the housing when the mat is positioned on the top panel and the casing is positioned within the hole of the mat.

2. The induction cooktop system of claim 1, wherein the top panel is a ceramic top panel, the temperature sensor assembly further comprising a plurality of elastic pads positioned on the bottom plate, the plurality of elastic pads extending between the bottom plate and the ceramic top panel when the mat is positioned on the ceramic top panel of the housing and the casing is positioned within the hole of the mat.

3. The induction cooktop system of claim 2, wherein the plurality of elastic pads is a plurality of silicon pads.

4. The induction cooktop system of claim 2, wherein the casing is an aluminum casing.

5. The induction cooktop system of claim 1, wherein the casing is a one-piece casing and the top plate and the bottom plate of the casing are integrally formed by the one-piece casing.

6. The induction cooktop system of claim 1, wherein the top plate is mounted to the bottom plate at a press-fit interface, the press-fit interface comprising a stub and a stub hole, the stub extending from one of the top and bottom plates and the stub hole defined by the other of the top and bottom plates, the stub pressed into the stub hole.

7. The induction cooktop system of claim 5, wherein additional potting compound is positioned within the press-fit interface.

8. The induction cooktop system of claim 1, wherein the hole of the mat is a circular hole.

9. The induction cooktop system of claim 1, wherein the temperature sensor assembly is selectively adjustable between a mounted configuration and an unmounted configuration, the casing positioned within the hole of the mat in the mounted configuration, the casing removed from the hole of the mat in the unmounted configuration.

10. An induction cooktop system, comprising:

a housing with a ceramic top panel;

an induction coil positioned within the housing below the ceramic top panel;

a silicon mat positionable on the ceramic top panel of the housing, the silicon mat defining a hole; and a temperature sensor assembly comprising an aluminum casing mountable to silicon mat at the hole of the silicon mat, the aluminum casing having a top plate and a bottom plate, the silicon mat positioned between the top plate and the bottom plate of the aluminum casing when the aluminum casing is positioned within the hole of the silicon mat;

a temperature sensor disposed within the aluminum casing between the top plate and the bottom plate of the aluminum casing;

a potting compound, the temperature sensor encased within the potting compound inside the aluminum casing such that the potting compound blocks liquids from contacting the temperature sensor, wherein the temperature sensor comprises a thermistor, a thermocouple, or a resistance temperature detector, and wherein the mat and the temperature sensor assembly are positioned over the top panel of the housing when the mat is positioned on the top panel and the casing is positioned within the hole of the mat.

11. The induction cooktop system of claim 10, wherein the temperature sensor assembly further comprises a plurality of elastic pads positioned on the bottom plate, the plurality of elastic pads extending between the bottom plate and the ceramic top panel when the silicon mat is positioned on the ceramic top panel of the housing and the aluminum casing is positioned within the hole of the silicon mat.

12. The induction cooktop system of claim 11, wherein the plurality of elastic pads is a plurality of silicon pads.

13. The induction cooktop system of claim 10, wherein the potting compound waterproofs the temperature sensor within the aluminum casing.

14. The induction cooktop system of claim 10, wherein the top plate is mounted to the bottom plate at a press-fit interface, the press-fit interface comprising a stub and a stub hole, the stub extending from one of the top and bottom plates and the stub hole defined by the other of the top and bottom plates, the stub pressed into the stub hole.

15. The induction cooktop system of claim 14, wherein additional potting compound is positioned within the press-fit interface.

16. The induction cooktop system of claim 10, wherein the hole of the silicon mat is a circular hole.

17. The induction cooktop system of claim 10, wherein the temperature sensor assembly is selectively adjustable between a mounted configuration and an unmounted configuration, the aluminum casing positioned within the hole of the silicon mat in the mounted configuration, the aluminum casing removed from the hole of the silicon mat in the unmounted configuration.

18. An induction cooktop temperature measurement system, comprising:

a silicon mat defining a circular hole; and a temperature sensor assembly comprising an aluminum casing mountable to silicon mat at the circular hole of the silicon mat, the aluminum casing having a top plate and a bottom plate, the silicon mat positioned between the top plate and the bottom plate of the aluminum casing when the aluminum casing is positioned within the hole of the silicon mat;

a temperature sensor disposed within the aluminum casing between the top plate and the bottom plate of the aluminum casing;

a potting compound, the temperature sensor encased within the potting compound inside the aluminum casing such that the potting compound blocks liquids from contacting the temperature sensor; and an elastic pad positioned on the bottom plate of the aluminum casing, wherein the temperature sensor comprises a thermistor, a thermocouple, or a resistance temperature detector.

* * * * *